US005730353A

United States Patent [19]

Holley, Jr.

[11] Patent Number: 5,730,353

[45] Date of Patent: Mar. 24, 1998

[54] CARTON AND BLANK FOR VERTICAL PACKAGING OF ARTICLES

[75] Inventor: John M. Holley, Jr., Lawrenceville, Ga.

[73] Assignee: The Mead Corporation, Dayton, Ohio

[21] Appl. No.: 681,000

[22] Filed: Jul. 16, 1996

[51] Int. Cl.[6] ..... B65D 5/36; B65D 5/54

[52] U.S. Cl. ..... 229/117.05; 206/430; 229/162; 229/240; 229/242

[58] Field of Search ..... 229/93, 101.1, 229/101.2, 117.01, 117.05, 117.06, 162, 240, 242; 206/427, 429, 430

[56] References Cited

U.S. PATENT DOCUMENTS

| | | | |
|---|---|---|---|
| 1,321,740 | 11/1919 | Harman | 229/93 |
| 1,532,316 | 4/1925 | Kaufman | 229/117.06 |
| 1,541,532 | 6/1925 | Simmons | 229/101.1 |
| 2,006,952 | 7/1935 | Klein | 229/117.01 |
| 2,603,409 | 7/1952 | Crary | 229/117.01 |
| 2,680,556 | 6/1954 | Currie | 229/117.01 |
| 2,867,368 | 1/1959 | Kaplan | 229/240 |
| 3,263,806 | 8/1966 | Ring | 206/427 |
| 3,386,569 | 6/1968 | Gentry | 206/430 |
| 4,230,729 | 10/1980 | Hoelzel, Jr. | 229/117.01 |
| 4,696,402 | 9/1987 | Harmon et al. | 229/120.011 |
| 4,742,917 | 5/1988 | Bornwasser et al. | 229/120.011 |
| 5,020,663 | 6/1991 | Dallas et al. | 229/101.1 |
| 5,377,833 | 1/1995 | Ranger | 206/430 |
| 5,516,039 | 5/1996 | Kirchhoff | 229/162 |

FOREIGN PATENT DOCUMENTS

| | | |
|---|---|---|
| 989040 | 4/1965 | United Kingdom . |
| 1170996 | 11/1969 | United Kingdom . |

*Primary Examiner*—Gary E. Elkins
*Attorney, Agent, or Firm*—Michael V. Drew

[57] ABSTRACT

An elongated tubular carton (10) formed from a blank (12) is collapsible about a pair of diametrically opposed fold lines. The carton (10) has a segmented tear strip (60, 62, 64, 66) and display apertures (70).

2 Claims, 2 Drawing Sheets

CARTON AND BLANK FOR VERTICAL PACKAGING OF ARTICLES

BACKGROUND OF THE INVENTION

The invention relates to cartons for articles, and more particularly to tubular cartons for vertically stacked articles.

Cartons for packaging multiple articles are useful as a means for transporting and storing multiples of an article. A carton for packaging articles in a vertical arrangement is useful both as a means for transporting and storing and as an aesthetic packaging alternative. Examples of vertical packaging structures are U.S. Pat. No. 3,263,806 to Ring, U.S. Pat. No. 3,386,569 to Gentry, and U.S. Pat. No. 5,377,833 to Ranger.

SUMMARY OF THE INVENTION

According to a preferred embodiment of the invention a tubular carton is erectable from a collapsed state and is formed from a blank. The tubular carton is collapsible about a pair of opposing fold lines. The carton has an elongated segmented tear strip. Each tear strip segment is removable in a manner which allows the tube to be incrementally opened along its length. The carton also has product display apertures spaced along its length.

Other advantages and objects of the present invention will be apparent from the following description, the accompanying drawings, and the appended claims.

DETAILED DESCRIPTION OF THE PREFERRED EMBODIMENT

Figure 1:
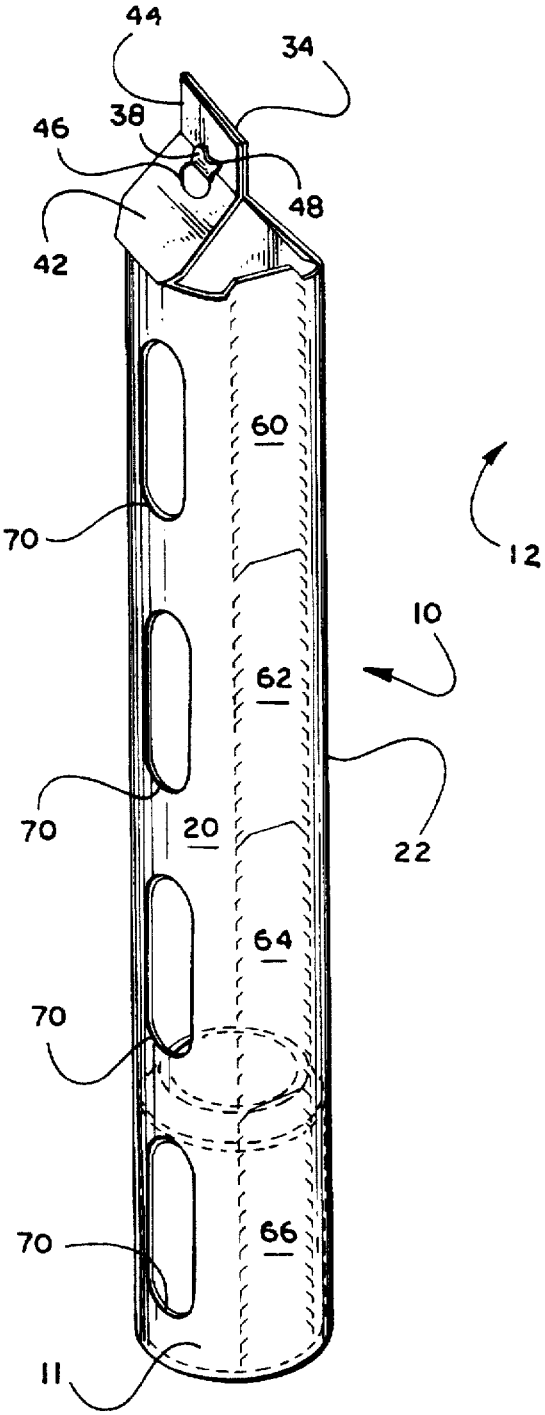
FIG. 1 is an isometric illustration of a carton for vertical packaging of articles according to a preferred embodiment of the invention.
Figure 2:
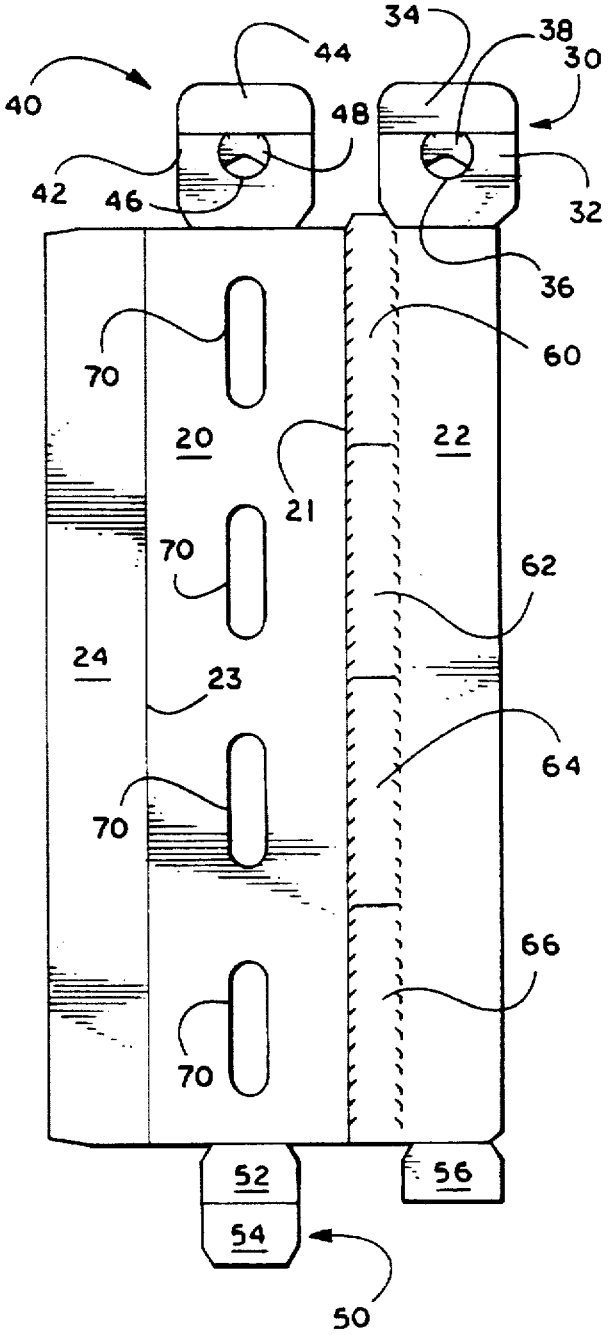
FIG. 2 is a blank for forming the carton of FIG. 1.
Figure 3:
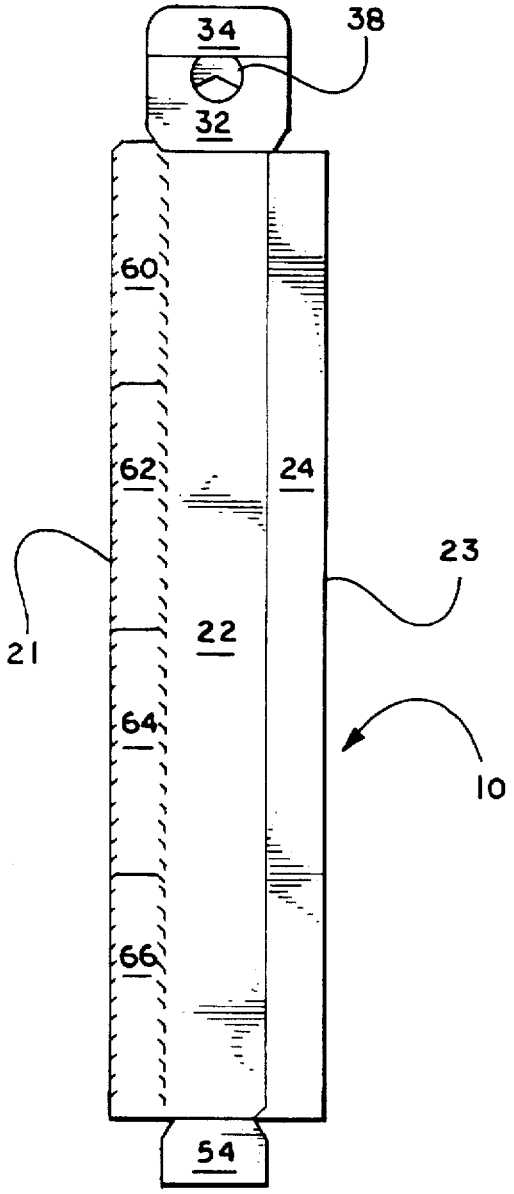
FIG. 3 is a side view of one side of the collapsed carton of FIG. 1.
Figure 4:
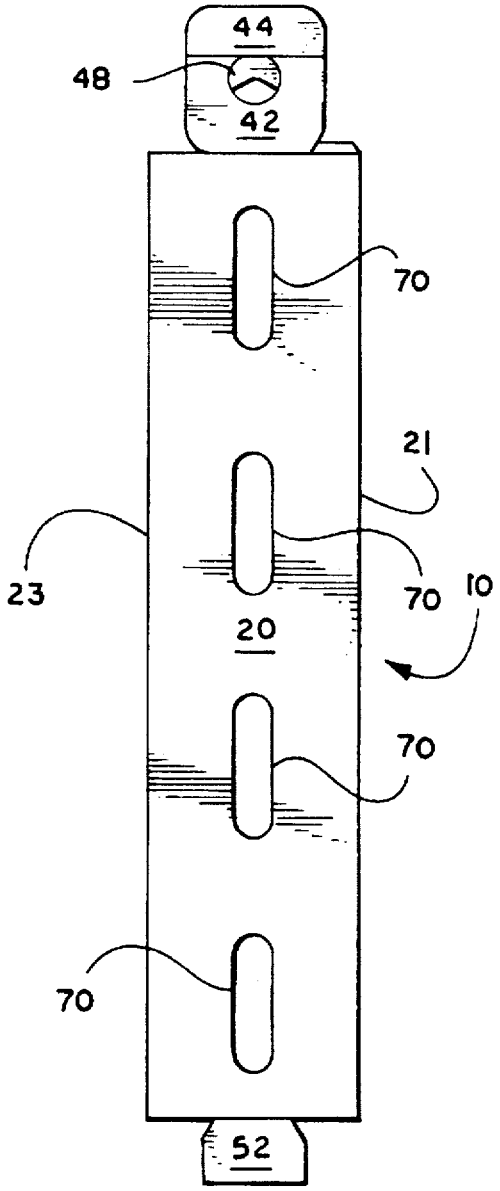
FIG. 4 is a side view of the opposite side of the collapsed carton of FIG. 3.

Throughout the figures, the same reference numerals are used to refer to identical features of the preferred embodiment illustrated. Referring first to FIG. 1, therein is illustrated a carton 10 for vertical packaging of articles according to a preferred embodiment of the invention. For clarity of understanding, reference is also simultaneously made to the blank of FIG. 2. While FIG. 1 illustrates a preferred embodiment of the tubular carton 10 of the invention in erected form, FIG. 2 illustrates a blank 12 from which the carton of FIG. 1 is formed. FIGS. 3 and 4 may also be referenced for an illustration of the features described below in a collapsed carton 10.

The elongated body of the carton 10 is formed from two sides of a collapsed carton 10 (shown in FIGS. 3 and 4) erected into tubular form. One of the two sides is an elongated panel 20. The opposing side of the tube is one or two lap panels 22, 24 foldably joined along respective longitudinal edges of the elongated panel. If only one lap panel is used, its unjoined edge is attached to the unjoined edge of the elongated panel 20. In the preferred embodiment illustrated, two lap panels 22, 24 are used to form closure for the tube. For clarity, these lap panels are referred to as a primary lap panel 22 and a secondary lap panel 24. The lap panels 22, 24 are joined to the elongated panel 20 along respective fold lines 21, 23. Joinder of unjoined edges of panels to form tube closure may be accomplished by suitable carton closure mechanism such as mechanical lock or adhesion of the surface of one panel to the surface of an overlapping panel. Referring now also to FIG. 3, in the preferred embodiment illustrated, primary lap panel 22 is overlapped with secondary lap panel 24 to form closure for the tube.

In the upright carton 10, one end of the carton 10, the bottom end in the upright orientation, an end closure is formed by tabs or flaps 50, 56. These closure tabs/flaps 50, 56 foldably adjoin lower transverse edges of the elongated panel 20 and one of the lap panels 22, respectively. Although a single tab or flap depending from only one of the panels which form the tube could be used to form the end closure, in the preferred embodiment illustrated, the tab/flap 50 adjoining the elongated panel 20 is divided by a fold line into two segments 52, 54 such that the outermost segment 54 overlaps with the tab/flap 56 of the opposing wall panel. The tabs/flaps 54, 56 may be joined in the manner described above regarding joinder of the tube portion of the carton 10.

At the top portion of the upright carton 10, a closure and handle structure is formed by a pair of opposing flaps 30, 40 foldably adjoined to top transverse edges of one of the lap panels 22 and the elongated panel, respectively. Each top handle/closure flap 30, 40 is divided by a respective fold line into a bottom portion 32, 42 and a top portion 34, 44, respectively. Each bottom portion 32, 42 contains a finger or hand hole 36, 46 enclosing a cushion tab 38, 48.

A segmented elongated tear strip extends longitudinally through the carton 10 and blank 12 and is formed by a series of adjacent distinct tear strip segments 60, 62, 64, 66. The tear strip segments 60, 62, 64, 66 are defined in known manner by opposing weakened, or tear, lines. A series of viewing apertures 70 are longitudinally aligned along the carton 10 and blank 12.

The lap portions 22, 24 of the blank 12 are brought together and affixed to form the carton tube 10. The bottom closure flaps 54, 56 are brought together and affixed to form the bottom closure for the tube 10. The fold lines 21, 23 of the tube portion of the carton and the fold line between the flaps 52, 54 depending from the elongated panel 20 enable the carton 10 to be collapsed about those fold lines. Cartons 10 are easily shipped and stored in the collapsed state. The collapsed carton 10 is easily erected to insert articles such as soft drink containers 11. The articles are viewable through the viewing apertures 70. The handle structure of the carton 10 is formed by placing the top portions 34, 44 of the handle flaps 30, 40 together and pushing one cushion tab 38, 48 through both finger/hand hole apertures to lock the handle flaps 30, 40 together. Articles may be removed from the carton 10 from the topmost article downward by tearing out the corresponding individual segments 60, 62, 64, 66 from topmost descending order. Articles may also be removed by opening the handle structure and extracting articles through the top opening of the carton.

Other modifications may be made in the foregoing without departing from the scope and spirit of the claimed invention. For example, the viewing apertures 70 are illustrated as having a generally elliptical configuration; however, the apertures may have any configuration suitable for displaying the contents of the carton 10.

What is claimed is:

1. A carton for vertical packaging of articles, the carton comprising an elongated tube having a first end closure, said elongated tube collapsible about a pair of longitudinally extending diametrically opposed fold lines, and having a segmented tear strip extending longitudinally through said elongated tube wherein a longitudinal edge thereof is coincident with one of said pair of diametrically opposed fold lines.

2. A blank for forming a carton, the blank comprising:

a first elongated panel having diametrically opposed elongated edges;

a lap panel foldably adjoining at least one of said elongated edges such that a tubular structure collapsible about said elongated edges is formed when unjoined longitudinal edges of said first elongated panel and said lap panel are attached to one another;

a segmented tear strip longitudinally extending through one of said first elongated panel and said lap panel such that a longitudinal edge of said segmented tear strip is coincident with one of said diametrically opposed elongated edges; and a first end closure structure adjoining at least one of said first elongated panel and said lap panel such that when said collapsible tubular structure is formed said first end closure is also collapsible.

* * * * *